US008574100B2

(12) United States Patent
Hasegawa et al.

(10) Patent No.: US 8,574,100 B2
(45) Date of Patent: Nov. 5, 2013

(54) METHOD FOR FITTING GOLF CLUB

(75) Inventors: Hiroshi Hasegawa, Kobe (JP); Masahide Onuki, Kobe (JP)

(73) Assignee: SRI Sports Limited, Kobe (JP)

( * ) Notice: Subject to any disclaimer, the term of this patent is extended or adjusted under 35 U.S.C. 154(b) by 97 days.

(21) Appl. No.: 13/276,719

(22) Filed: Oct. 19, 2011

(65) Prior Publication Data

US 2012/0108364 A1 May 3, 2012

(30) Foreign Application Priority Data

Nov. 2, 2010 (JP) ..... 2010-246234

(51) Int. Cl.
*A63B 53/00* (2006.01)

(52) U.S. Cl.
USPC ..... 473/409; 473/282

(58) Field of Classification Search
USPC ..... 473/289
See application file for complete search history.

(56) References Cited

U.S. PATENT DOCUMENTS

| | | | | | |
|---|---|---|---|---|---|
| 5,419,562 | A * | 5/1995 | Cromarty | 473/269 |
| 5,821,417 | A | 10/1998 | Naruo et al. | |
| 6,000,286 | A | 12/1999 | Naruo et al. | |
| 6,003,368 | A | 12/1999 | Naruo et al. | |
| 6,014,887 | A * | 1/2000 | Naruo et al. | 73/12.04 |
| 6,041,651 | A * | 3/2000 | Naruo et al. | 73/491 |
| 6,083,123 | A * | 7/2000 | Wood | 473/409 |
| 2006/0111197 | A1 | 5/2006 | Yamamoto et al. | |
| 2009/0326688 | A1 * | 12/2009 | Thomas et al. | 700/91 |

* cited by examiner

*Primary Examiner* — Michael Dennis
(74) *Attorney, Agent, or Firm* — Birch, Stewart, Kolasch & Birch, LLP

(57) ABSTRACT

A fitting method includes steps of preparing a relationship C of a shaft flex point Y and a face angle X before impact or at impact; measuring a subject's face angle X before impact or at impact by using a test club; and selecting a shaft fitted to the subject on the basis of the measured face angle X and the relationship C. The relationship C is created by using correlation R of the face angle before impact or at impact and a hitting result. The correlation R is based on hitting results of a plurality of golf clubs having different shaft flex point rates. Preferably, the relationship C is a relational expression F1.

9 Claims, 15 Drawing Sheets

METHOD FOR FITTING GOLF CLUB

This application involves a claim for benefits based on Japanese Patent Application No. 2010-246234 filed in Japan on Nov. 2, 2010, the entire contents of which are hereby incorporated by reference.

BACKGROUND OF THE INVENTION

1. Field of the Invention

The present invention relates to fitting of a golf club.

2. Description of the Related Art

Selection of a golf club fitted to a golf player is called fitting. One who performs fitting of a golf club for a golf player is called a fitter. Physical properties of a shaft of a golf club have a great impact on the fitting.

For example, one of shaft physical properties is flex. The flex represents hardness of a shaft. In general, for the flex, fit hardness is recommended based on magnitude of a head speed. For a golf player whose head speed is relatively slow, a flexible shaft is recommended. For a golf player whose head speed is relatively fast, a hard shaft is recommended. However, there is no uniform standard on the flex, and different standard is defined for each of manufacturers. Selection of a fit flex value often relies on a fitter's experience and intuition.

As other shaft physical properties, a flex point, torque, and weight are exemplified. Also for a flex point, torque, and weight, there is no other way than relying on a fitter's experience and intuition. Fitting by a fitter involves variations, etc. due to the fitter's subjectivity. Thus, in such fitting, a golf club to be selected will be different if a fitter differs.

Hence, it is proposed to measure swings of a golf player and perform fitting based on result of the measurement. For example, in the Patent Publication No. 3061640 (U.S. Pat. No. 5,821,417, U.S. Pat. No. 6,000,286, U.S. Pat. No. 6,003,368, U.S. Pat. No. 6,014,887, U.S. Pat. No. 6,041,651), timing of swings is measured. An fit shaft is recommended based on the measured timing. In the Patent Publication No. 4184363 (US2006/0111197), a head speed before impact and a speed of a grip unit are measured. A fit shaft is recommended based on the head speed and the speed of the grip unit. These methods enables fitting in an objective manner.

SUMMARY OF THE INVENTION

However, with these methods, a relationship of hitting result and fitting is not clear. Not only in fitting based on the timing of swings but also in the fitting based on the head speed and the speed of the grip unit, a relationship with hitting results has not been clarified. It is believed that the unclear relationship is one of the factors for hitting results (flight distance, flying direction and the like) not being improved.

An objective of the present invention is to provide a precise fitting method.

A fitting method according to the present invention includes steps of preparing a relationship C of a shaft flex point Y and a face angle X before impact or at impact; measuring a subject's face angle X before impact or at impact by using a test club; and selecting a shaft fitted to the subject on the basis of the measured face angle X and the relationship C. The relationship C is created by using correlation R of the face angle before impact or at impact and a hitting result. The correlation R is based on hitting results of a plurality of golf clubs having different shaft flex point rates.

Preferably, the relationship C is a relational expression F1.

Preferably, the relational expression F1 is such a relational expression that the greater the face angle X is, the lower the shaft flex point Y is. In other words, the relational expression F1 is such a relational expression that the greater the face angle X is, the greater the shaft flex point rate Y is.

Preferably, the step of preparing the relational expression F1 includes steps of: obtaining the relational expression F1 on the basis of a first hitting result; and modifying the relational expression F1 on the basis of a second hitting result.

Preferably, the step of modifying the relational expression F1 on the basis of the second hitting result includes steps of: identifying a standard shaft flex point Yh; and modifying the relational expression F1 so that the second hitting result is preferred at the standard shaft flex point Yh.

Preferably, the first hitting result is a direction of a hit ball. Preferably, the second hitting result is a result on a flight distance.

Preferably, a preferred hitting result at a standard shaft flex point Yh is reflected in the relational expression F1.

Preferably, in the relational expression F1, the measured face angle X is made a first input variable, a value showing a relationship of a shaft flex point D1 of the test club and the standard shaft flex point Yh is made a second input variable, and the shaft flex point Y fitted to the subject is made a result variable.

Preferably, the hitting result is a direction of a hit ball.

With the present invention, more precise fitting can be implemented.

DESCRIPTION OF THE PREFERRED EMBODIMENTS

The present invention will be described in detail hereinafter with reference to the drawings, as appropriate, and based on preferred embodiments.

Figure 1:
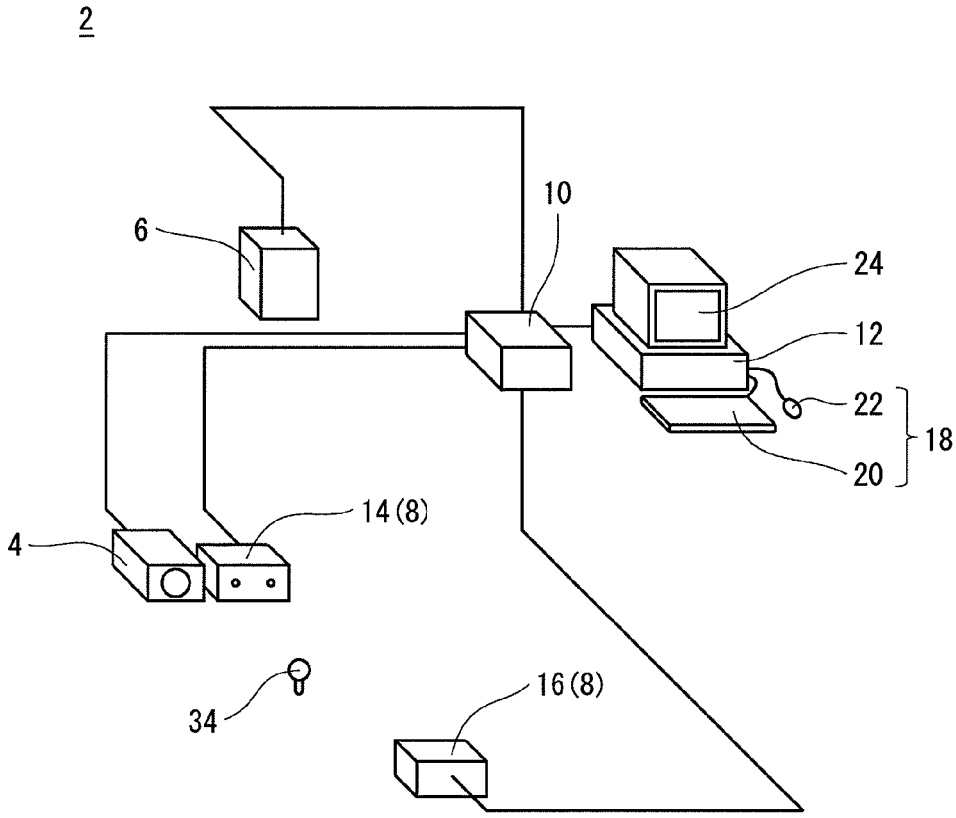
FIG. 1 is a schematic view showing a configuration of a fitting device according to the present invention.

A fitting device 2 shown in FIG. 1 is for a right-handed golf player. The fitting device 2 includes a front face camera 4 and an upper camera 6 as an image shooting section, a sensor 8, a controller 10, and an information processor 12 as a calculating section. The sensor 8 includes a light emitter 14 and a light receiver 16.

The front face camera 4 is located in front of a swinging golf player. The front face camera 4 is arranged at a position and in a direction so that it can shoot an image of a swing from the front-side of the golf player. The upper camera 6 is located above a position where a ball 34 is placed. The upper camera 6 is arranged at a position and in a direction so that it can shoot an image of a swing from above the golf player. As the front face camera 4 and the upper camera 6, a CCD camera is exemplified. The front face camera 4 and the upper camera 6 are exemplified. A camera capable of shooting from the front or a camera capable of shooting from the back may be further included. A camera capable of shooting from the front or the back or diagonal may be provided in place of the front face camera 4 or the upper camera 6.

The light emitter 14 of the sensor 8 is located in front of a swinging golf player. The light receiver 16 is located at the feet of the swinging golf player. The light emitter 14 and the light receiver 16 are arranged at positions between which a golf club to be swung passes. The sensor 8 can detect a head or a shaft of the passing golf club. The sensor 8 may be arranged in the front or the back, as far as it is arranged at a position where it can detect the head or the shaft. The sensor 8 is not limited to one including the light emitter 14 and the light receiver 16. The sensor 8 may be of a reflection type.

The controller 10 is connected to the front face camera 4, the upper camera 6, the sensor 8, and the information processor 12. The controller 10 can transmit a shooting start signal and a shooting stop signal to the front face camera 4 and the upper camera 6. The controller 10 can receive a swing image signal from the front face camera 4 and the upper camera 6. The controller 10 can receive a detection signal of the head or the shaft from the sensor 8. The controller 10 can output to the information processor 12 the swing image signal and the head or shaft detection signal.

Figure 2:
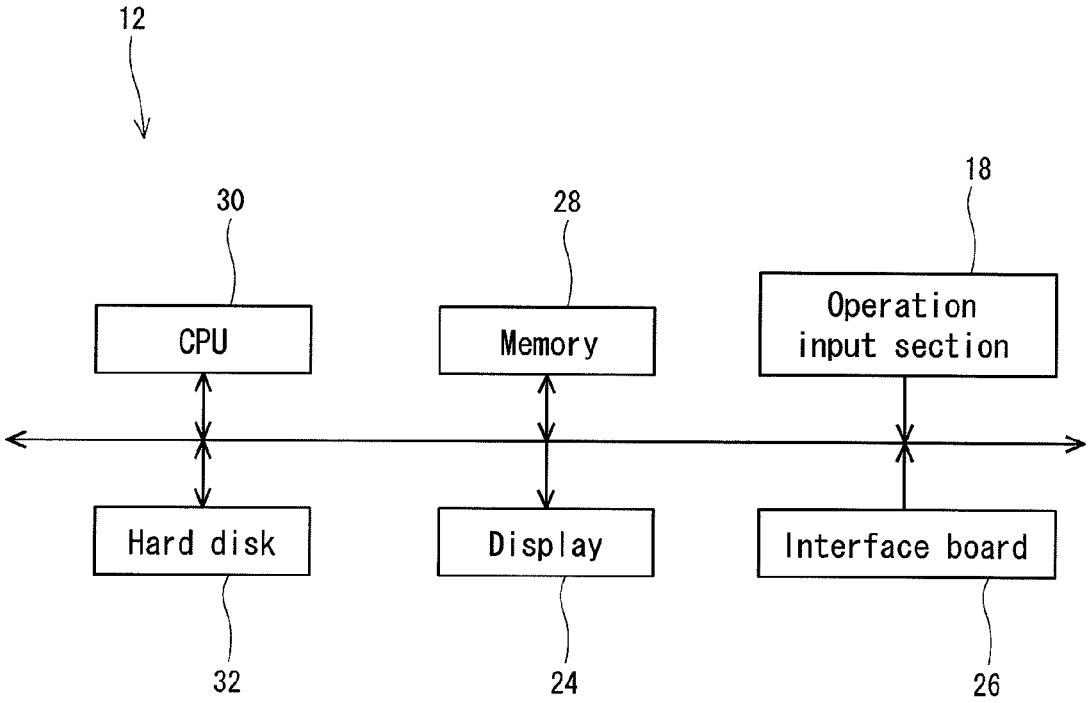
FIG. 2 is an illustration showing a system configuration of an information processor which constitutes the fitting device of FIG. 1.

As shown in FIG. 1 and FIG. 2, the information processor 12 includes a keyboard 20 and a mouse 22 as an information input section 18, a display 24 as an output section, an interface board 26 as a data input section, a memory 28, a CPU 30, and a hard disk 32. For the information processor 12, a general-purpose computer may be directly used.

The display 24 is controlled by the CPU 30. The display 24 displays various types of information. The output section may be any one as far as it displays fitting information such as a fit shaft, a fit golf club or swing measurement data or the like. The output section is not limited to the display 24, and a printer, for example, may be used.

To the interface board 26 are input swing image signals and head or shaft detection signals or the like. Measurement data is acquired from the image signals or detection signals. The measurement data is output to the CPU 30.

The memory 28 is a rewritable memory. The hard disk 32 stores a program or data or the like. For example, values of a plurality of shaft physical properties are stored as a database. Specifically, for example, data or expressions or the like representative of a relationship of an indicator and hitting result for each value of the physical properties are stored. The memory 28 constitutes a storage area or a working area or the like for the programs or the measurement data read from the hard disk 32.

The CPU 30 can read a program stored in the hard disk 32. The CPU 30 can run the program in the working area of the memory 28. The CPU 30 can execute various processes in accordance with the program.

Figure 3:
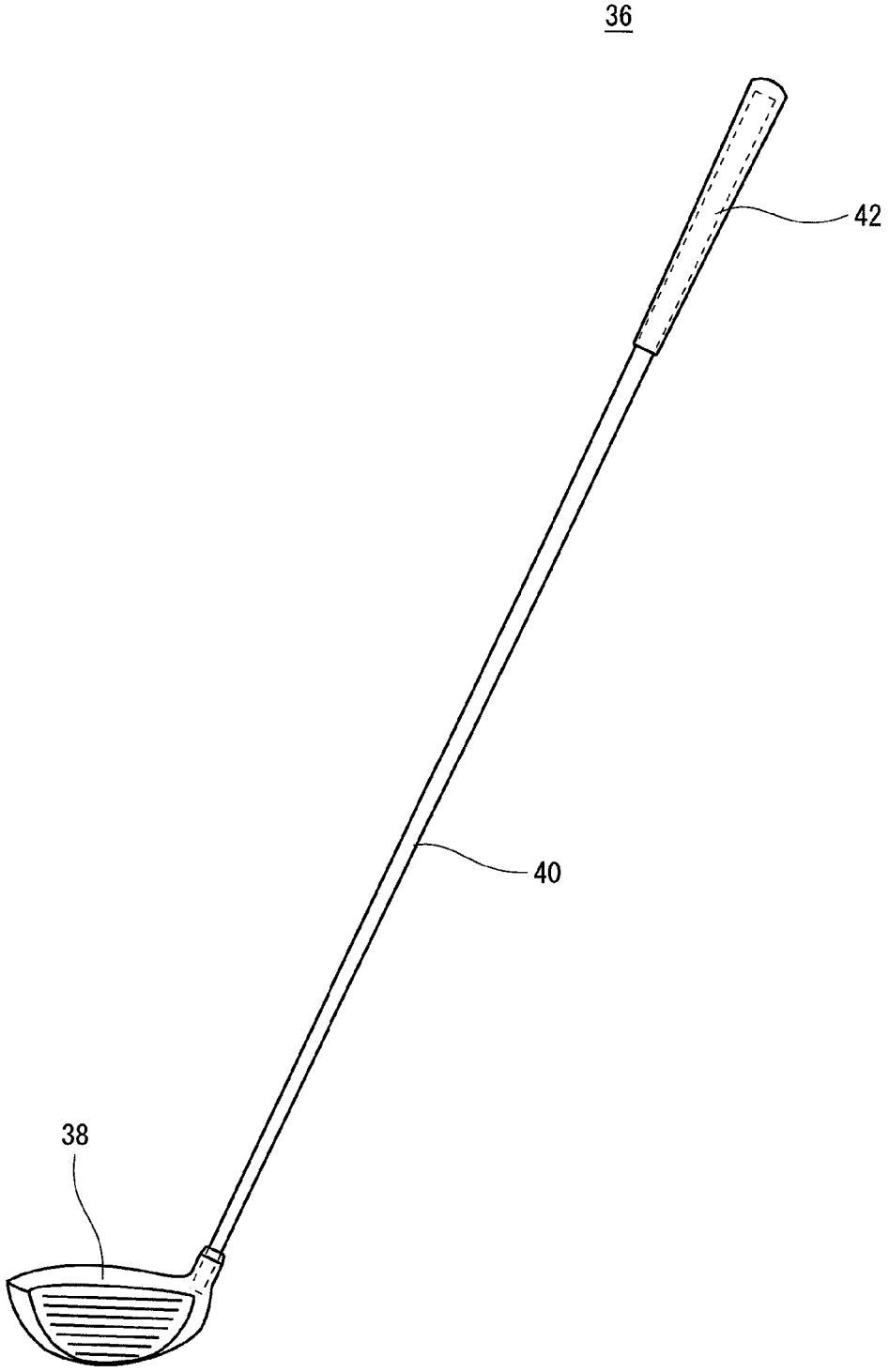
FIG. 3 is a front view of a golf club used in the fitting device of FIG. 1.

A golf club 36 shown in FIG. 3 is an example of a golf club used in the fitting device 2. A golf club used in fitting which will be described later is called a test club. The golf club 36 is an example of a test club. The golf club 36 includes a head 38, a shaft 40, and a grip 42.

Figure 4A:
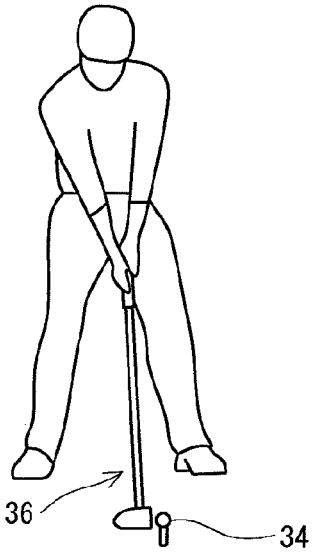
FIGS. 4A to 4D are illustrations of swing positions.
Figure 4B:
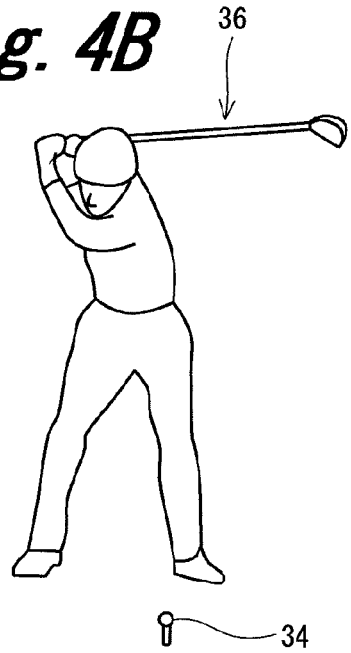
Figure 4C:
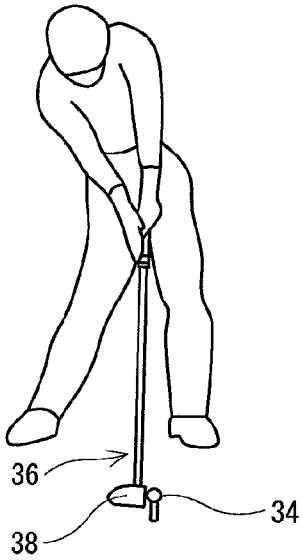
Figure 4D:
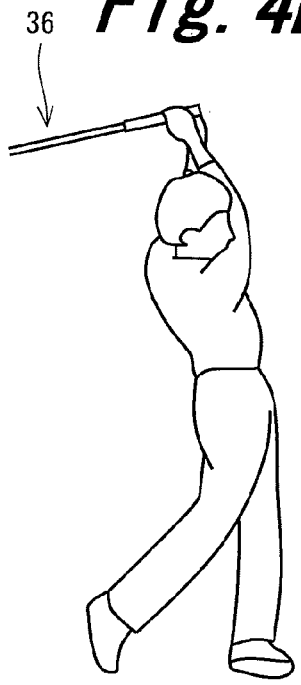

FIGS. 4A to 4D show respective positions at which a golf player swings. A position in FIG. 4A is an address. A position in FIG. 4B is a top of swing (hereinafter, also referred to as a top). A position in FIG. 4C is an impact. An impact is a position at the moment when the head 38 and the ball 34 collide. A position in FIG. 4D is a finish. A golf player's swing sequentially shifts from the address to the finish through the top and the impact. The swing ends at the finish.

Figure 5:
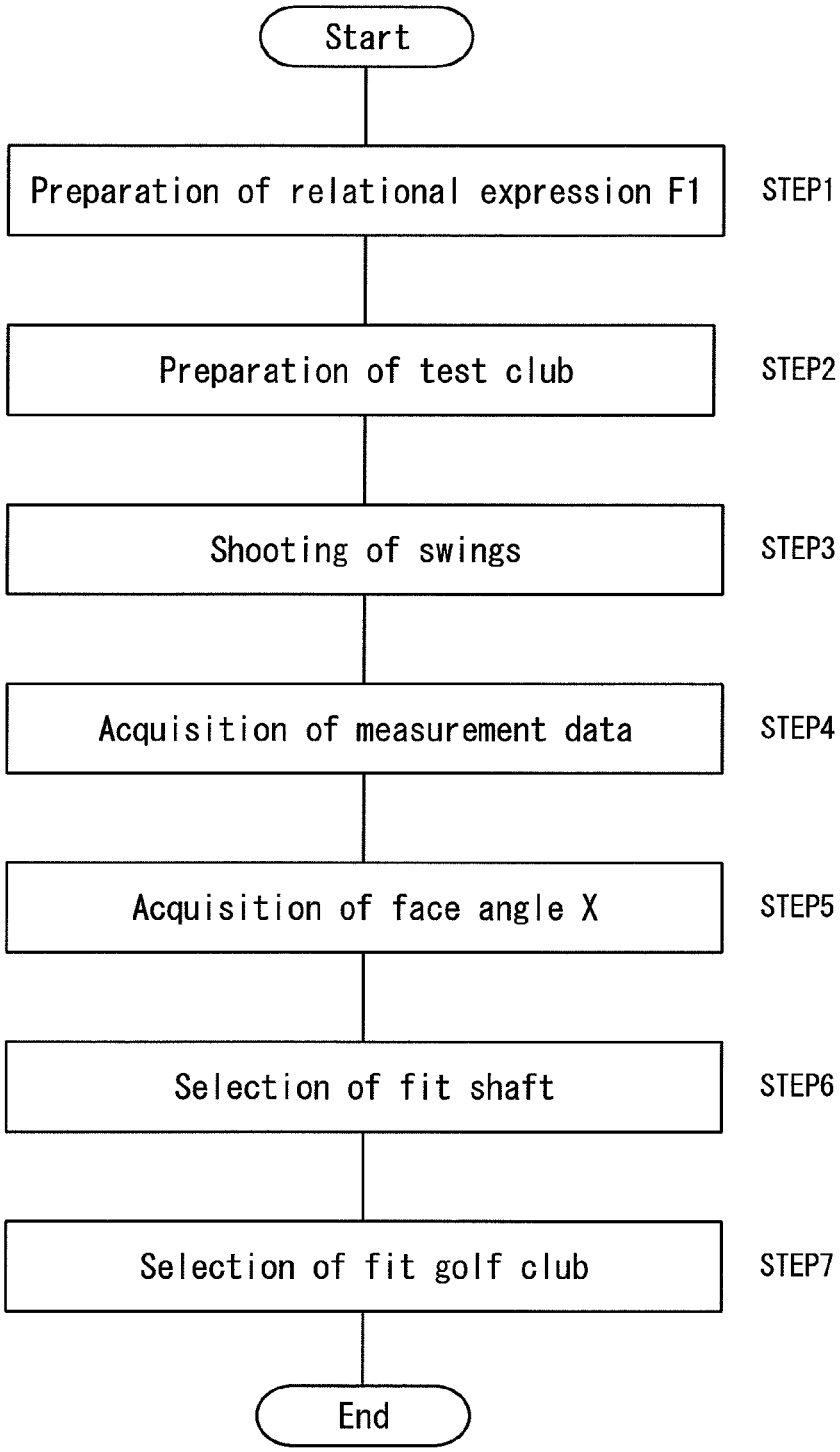
FIG. 5 is a flow chart showing one example of a fitting method according to the present invention.

FIG. 5 shows one example of a procedure of a fitting method of a golf club according to the present invention. In the fitting method, hitting results are reflected. Data of hitting results which have been registered in advance in a database is used. As the hitting results, a ball flight distance or a ball direction (flying ball direction) is exemplified. As the ball direction, a right/left direction, an up/down direction, and a three-dimensional direction are exemplified. Using this database, correlation R is obtained. A relationship C is prepared based on the correlation R. One example of the relationship C is a relational expression F1.

With reference to FIG. 5, a description will be given, exemplifying a flight distance of the ball 34 as a hitting result. In the fitting method, a fit shaft is selected. As a shaft physical property to be considered, a shaft flex point is exemplified. As the shaft flex point, a low flex point, a middle flex point, and a high flex point are listed. Preferably, a shaft flex point is quantified. A quantified shaft flex point is expressed as a flex point rate. The quantification enables elaborate fitting. A method for calculating a preferred flex point rate will be described below.

In this fitting method, a face angle X before impact or at impact is measured. The expression before impact is considered as when a centerline of a tee and a face surface of the head 38 are at a predetermined distance which has been defined in advance. For example, the expression before impact is considered as when a distance between the centerline of tee and the face surface of the head 38 is 3 cm. If no tee is used, a vertical line passing through the center of the ball 34 may be used instead of the tee centerline. In some cases, measurement of a face angle X at impact may be difficult to perform, compared with a face angle X before impact. At the time when a face angle X is measured, a distance between the center of a ball and a face surface is preferably 10 cm or less, and more preferably 5 cm or less.

In the information processor 12 of FIG. 1, a database of a shaft flex rate, a flight distance, and a face angle has been created. Data in the database is acquired with an analysis method to be described below. Based on the database, correlation R is obtained. Using the correlation R, a relational expression F1 is created. This is a preparation step of the relational expression F1 (STEP 1). The relational expression F1 is used in the fitting method. The correlation R and the relational expression F1 will be described below.

Information identifying the head 38 and the shaft 40 is input into the information processor 12. Alternatively, the information identifying the head 38 and the shaft 40 may also be input from the keyboard 20 during fitting. The information identifying the head 38 or the shaft 40 may also be selected with the mouse 22 from multiple pieces of information appearing on the display 24.

The golf club 36 of FIG. 3 is prepared. This is a preparation step of the test club (STEP 2). A flex point of the shaft 40 of the golf club 36 is a middle flex point, for example. A shaft flex point of a test club is not limited. A shaft flex point may be a high flex point or a low flex point. As described below, preferably, a shaft flex point is indicated by a numeric value.

Swing images of a golf player are shot. This is a swing shooting step (STEP 3). A golf player takes an address position in the fitting device 2. The golf player swings. The golf player hits the ball 34 with the golf club 36. During swings, the sensor 8 detects the ball 34 and the head 38. The detection signal is output to the controller 10.

The controller 10 outputs the detection signal and a swing image signal to the information processor 12. The information processor 12 acquires measurement data from the signals. This is a measurement data acquisition step (STEP 4).

In the step (STEP 4), multiple swing image signals may be extracted. Each of the multiple swing image signals may be converted into measurement data. The controller 12 may determine measurement data to be used in fitting, from multiple pieces of measurement data, on the basis of information identifying an image.

The information processor 12 calculates a value of a face angle X from the measurement data. This is an acquisition step of a face angle X (STEP 5). In the fitting method, the (STEP 2) to (STEP 5) constitute the step of obtaining a measurement result of a face angle when a subject (golf player) hits a ball with test clubs.

Face angles X measured with multiple swings may be averaged. Use of an average value of the face angles X can improve precision of fitting.

The information processor 12 selects a fit shaft. This is a fit shaft selection step (STEP 6). Based on the measured face angle X and the relational expression F1 described above, a recommended shaft flex point rate Y is calculated. Based on the flex point rate Y, a fit shaft is selected.

The information processor 12 selects a golf club provided with a shaft of the fit shaft flex point Y. This is a fit golf club selection step (STEP 7). On the display 24, information identifying a golf player and fitting information such as a face angle X and a fit golf club or the like are displayed (diagrammatic representation omitted). The information may be printed by a printer, as the output section.

Based on the fit shaft flex point Y determined in the (STEP 6), the best fit head physical property may be further determined. This step is also called a head optimization step. In the head optimization step, a head physical property fitted to a subject is determined, using the shaft with the fit shaft flex point Y. In the head optimization step, using the fit shaft flex point Y, a ball is hit with a plurality of heads having different head physical properties. Preferably, in the multiple hits, face angles X are measured. Based on a measurement result of the face angles X, a head physical property fitted to the subject is determined.

As the head physical property, a centroid position of a head is listed. As the centroid position of the head, a centroid position in a toe-heel direction, a centroid position in a face/back direction, and a centroid height are exemplified. Preferably, a test head whose centroid position can be changed may be used. The test head includes male screws (weight screws) as a weight body and ports provided in multiple places of the head, for example. Each of the ports has a female screw. The weight screw may be attached to each of the ports. Changing weight or arrangement of the weight screws changes a centroid position of the head. In the head optimization step, hitting is performed with a plurality of clubs with heads which are made to have different centroid positions, by using the shaft with the fit shaft flex point Y.

Alternatively, a plurality of golf clubs with shafts which are close to the fit shaft flex point Y and mutually have different flex point rates may be prepared. A subject performs trial hitting with the golf clubs with shafts mutually having different flex points. From the trial hitting, a flex point rate with the best hitting result may be determined as an optimal flex point rate.

In addition, a plurality of shafts which have the fit shaft flex point Y and mutually different other shaft physical properties (flex, torque or weight) may be tested. A plurality of golf clubs provided with the shafts is prepared, and a subject performs trial hitting with the golf clubs. From the trial hitting, a shaft (golf club) with the best hitting result may be determined as an optimal shaft (golf club).

In the embodiment, a shaft flex point Y fitted to the subject is determined, using correlation R of the flight distance and the face angle of the ball 34. The correlation R is made a relational expression of the face angle before impact and the flight distance. The correlation R is based on hitting results with a plurality of golf clubs having different shaft flex point rates.

As a hitting result, a ball direction (flying direction) may be adopted. As the direction, a right/left direction (horizontal direction), an up/down direction (vertical direction), and a three-dimensional direction are exemplified. As the right/left direction, for example, a horizontal direction angle of a vector of an initial speed of a ball is listed. As other right/left direction, for example, a distance between a straight line connecting a hitting position with a target and a ball stop point, and a distance between a straight line connecting a hitting position with a target and a ball landing point are listed.

In the following, as a hitting result of the fitting method, the right/left direction (hereinafter also simply referred to a right/left deflection) is exemplified and described. Here, a configuration which differs from the fitting method described above will be mainly described. For a similar configuration, a description thereof will be omitted.

In the embodiment, a right/left deflection is shown by an angle. When a ball is launched straight to a target, a right/left deflection is considered an angle of 0 degree. When a ball is launched and deviated to the left, it is shown as a minus, and magnitude of the deflection is shown by an angle. When a ball is launched and deviated to the right, it is shown as a plus, and magnitude of the deflection is shown by an angle.

A database of a shaft flex point rate, a right/left deflection, and a face angle before impact is created in an information processor 12 of FIG. 1. This is a database creation step (STEP 1). Information identifying a head 38 and a shaft 40 is input in the information processor 12.

A golf club 36 of FIG. 3 is prepared. This is a test club preparation step (STEP 2). Swing images of a golf player are shot. This is a swing shooting step (STEP 3). The controller 10 outputs the detection signal and the swing image signal to the information processor 12. The information processor 12 acquires measurement data from the signals. This is a measurement data acquisition step (STEP 4). The information processor 12 calculates a value of a face angle X from the measurement data. This is an acquisition step of a face angle X (STEP 5).

The information processor 12 selects a fit shaft. This is a selection step of a fit shaft (STEP 6). Specifically, with an analysis method to be described below, a relationship of a right/left deflection of a ball 34, a shaft flex point rate, and a face angle is determined. Based on the relationship, correlation R of the right/left deflection and the face angle is stored for each shaft flex point rate. Based on the correlation R, a flex point rate of a shaft with the smallest right/left deflection is determined from values of face angles obtained from a golf player. The shaft flex point rate is a shaft flex point Y.

The information processor 12 selects a golf club with the shaft flex point Y. This is a fit golf club selection step (STEP 7). On the display 24, information identifying a golf player and fitting information such as a face angle and a fit golf club and the like are displayed.

In the embodiment, a shaft flex point Y fitted to a subject is determined, using a relationship of a right/left direction in which the ball 34 flies and a face angle.

Figure 6:
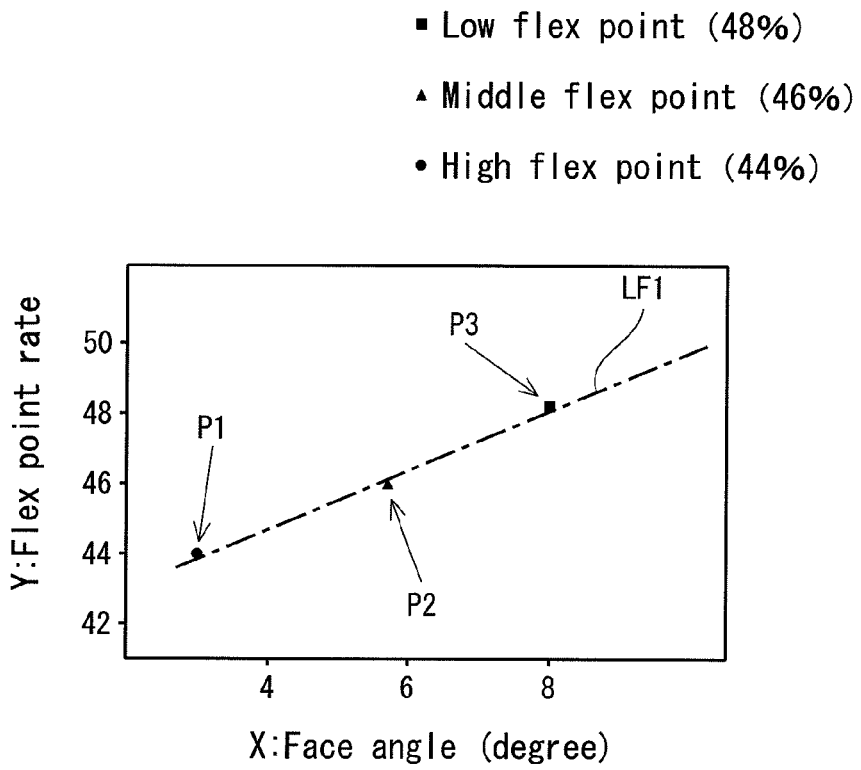
FIG. 6 is a graph showing a relationship (relational expression F1) of a flex point rate and a face angle when a right/left deflection is small.

FIG. 6 further shows other example of the selection step of an adapted shaft (STEP 6). A straight line LF1 of FIG. 6 shows a relational expression F1 of a face angle X and a flex point rate Y when the right/left deflection is smallest (the right/left deflection is 0 degree). A method for determining the relational expression F1 will be described below. The relational expression F1 is expressed in the following expression:

$$Y=A1\cdot X+B \text{(coefficient } A1 \text{ and intercept } B \text{ are constants)}$$

As a value of the face angle X, the face angle X obtained from the golf player is given. With substitution of the face angle X, a flex point rate Y is calculated. Among shaft flex point rates, one which is closest to the calculated flex point rate Y is selected. A shaft is selected based on the flex point rate. In addition, a shaft may be custom made based on the flex point rate.

As correlation R of a face angle and a hitting result, a multiple regression equation may be used. In a multiple regression expression, one objective variable is represented by a plurality of explanatory variables. A multiple regression analysis reflects which and how much explanatory variable affects an objective variable. As a plurality of explanatory variables is considered in a multiple regression expression, accuracy of fitting may be improved. A multiple regression equation is not limited, and a linear expression, a quadratic expression or the like are exemplified.

In addition, for example, as correlation R, the following multiple regression expression is obtained from a flight distance ratio H1 as a hitting result, a face angle X1, and a shaft flex point rate X:

$$H1=A2\cdot X1+A3\cdot X2+A4\cdot X1\cdot X2+B1 \text{(coefficients } A2, A3, \text{ and } A4, \text{ and intercept } B1 \text{ are constants.)}$$

The correlation R is determined from a relationship of a face angle before impact and a flight distance of when a plurality of golf players swing using a plurality of golf clubs with different shaft flex points. For example, shaft flex point rates are of three types: a high flex point, a middle flex point, and a low flex point.

The flight distance ratio H1 is determined, for example, based on a flight distance L at a middle flex point. The flight distance ratio H1 of the middle flex point is L/L, and 1. The flight distance ratio H1 of a flight distance La of a low flex point is determined as La/L. The flight distance ratio H1 of a flight distance Lb of a high flex point is determined as Lb/L. The coefficients A2, A3, A4, and the intercept B1 can be determined from a relationship of the shaft flex point, the face angle, and the flight distance (flight distance ratio).

Figure 7:
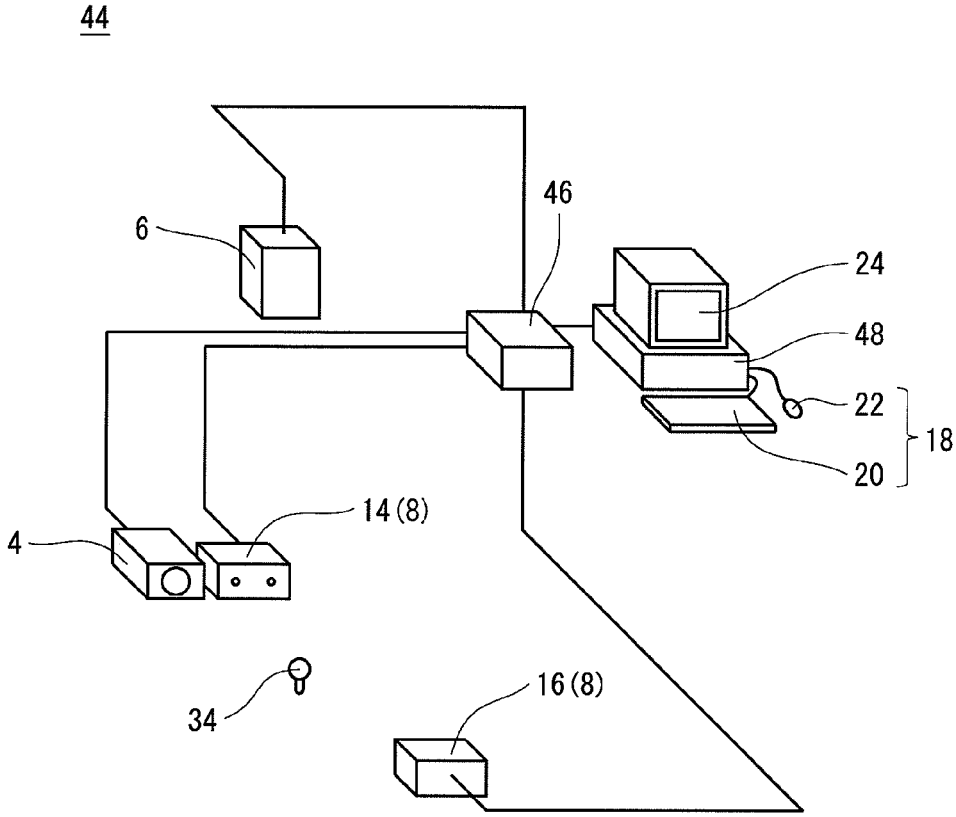
FIG. 7 is a schematic view showing one example of a configuration of a swing analyzer according to the present invention.

FIG. 7 shows a swing analyzer 44. The swing analyzer 44 includes a front face camera 4, an upper camera 6, a sensor 8, a controller 46, and an information processor 48 as a calculating section. Similar to those in the fitting device 2, a description of the front face camera 4, the upper camera 6, and the sensor 8 will be omitted.

Similar to the controller 10, the controller 46 controls the front face camera 4 and the upper camera 6. Similar to the controller 10, the controller 46 receives a detection signal of a head 38 or a shaft 40 from the sensor 8. The controller 10 may also be used as the controller 46.

Similar to the information processor 12, the information processor 48 includes a keyboard 20 and a mouse 22 as an information input section 18, a display 24 as an output section, an interface board 26 as a data input section, a memory 28, a CPU 30, and a hard disk 32. For the information processor 48, a general-purpose computer may be used directly. The information processor 12 may also be used as the information processor 48.

Figure 8:
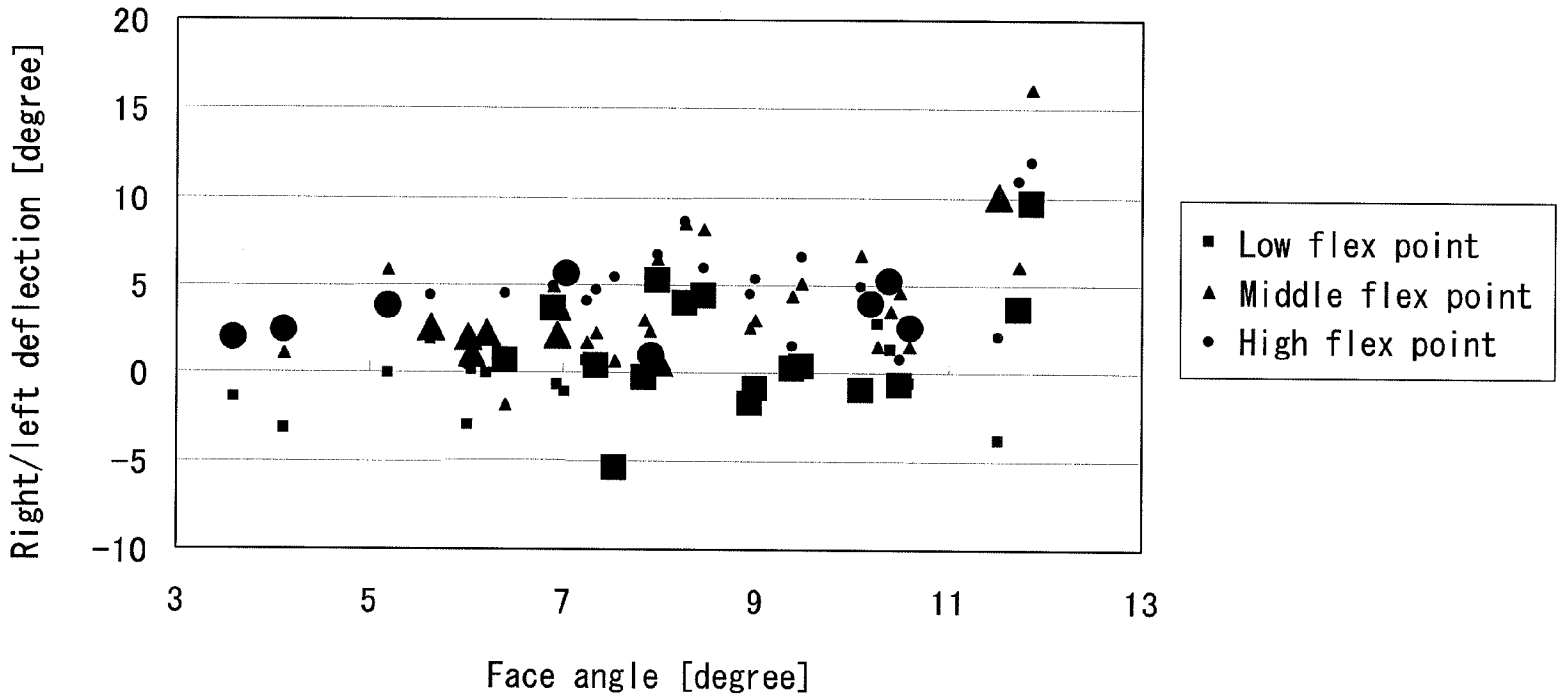
FIG. 8 is a graph showing a relationship (correlation R) of a flying direction of a ball (right/left deflection) and a face angle.

FIG. 8 shows right/left deflections of balls when a plurality of golf players hits the balls, at a low flex point, a middle flex point, and a high flex point. In the embodiment, a flex point rate of the low flex point is 48%, a flex point rate of the middle flex point is 46%, and a flex point rate of the high flex point is 44%.

In FIG. 8, a golf player can be identified by a value of a face angle. For each face angle, points of a golf club having the greatest flight distance are shown larger than points of other golf clubs. For each golf player (face angle), a right/left deflection when the flight distance is greatest tends to be smaller than shafts with other flex points. Specifically, at a shaft flex point rate when the flight distance is greatest, the right/left deflection tends to approximate to 0.

Figure 9:
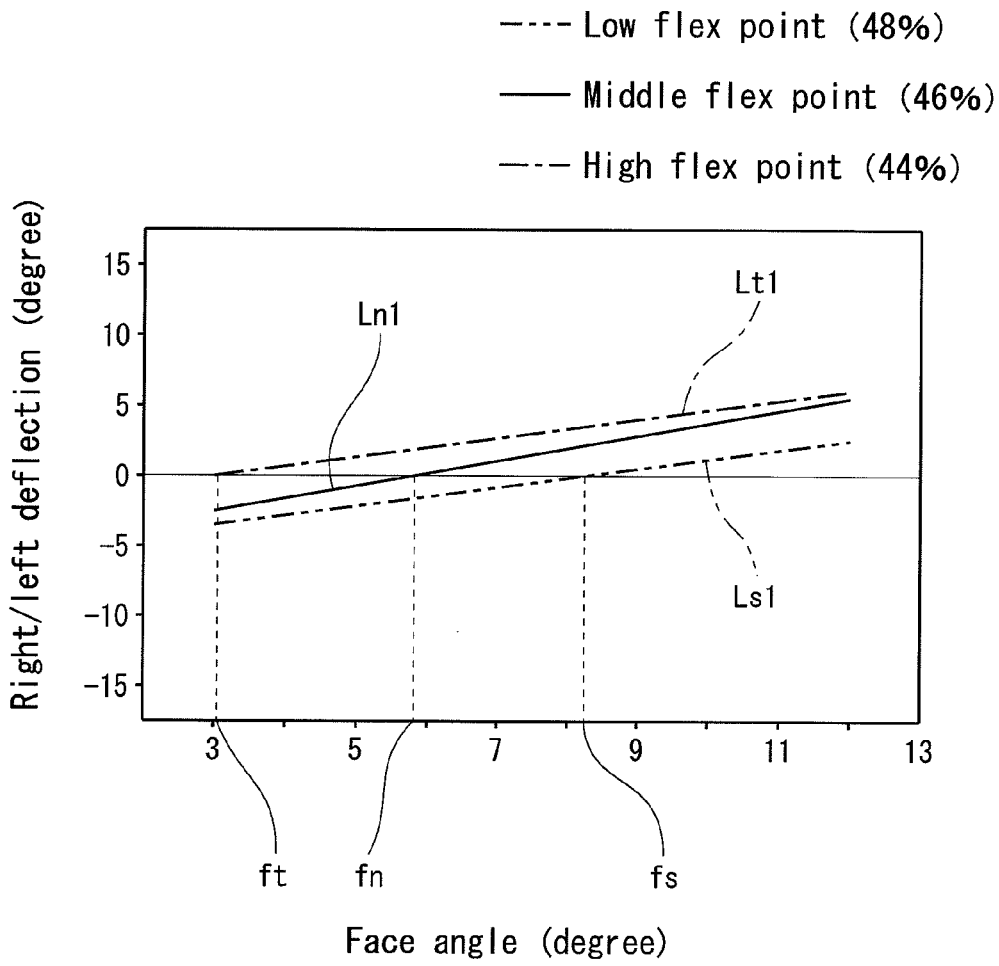
FIG. 9 is a graph showing a relationship (correlation R) of the right/left deflection and the face angle for each flex point rate.

FIG. 9 is a graph showing a relationship of a face angle and a right/left deflection. FIG. 9 is based on data of FIG. 8. For each flex point rate, relational expressions of face angles and right/left deflections are determined. The relational expressions are expressed by straight lines. The relational expressions (straight lines) are determined by regression analysis, using the least-square method. The straight line Ls1 of FIG. 9 is based on data of the low flex point in FIG. 8. The straight line Ln1 is based on data of the middle flex point in FIG. 8. The straight line Lt1 of FIG. 9 is based on data of the high flex point in FIG. 8. In addition, to facilitate understanding, the straight lines expressed in FIG. 9 have been modified. Based on the relational expression, a flex point rate for which a right/left deflection to a face angle of a golf player is smallest may be determined. Face angles when a right/left angle is 0 degree in each of the straight line Ls1, the straight line Ln1, and the straight line Lt1, can be determined. In the straight line Ls1, the face angle when the right/left deflection is 0 degree is fs degree (see FIG. 9). In the straight line Ln1, the face angle when the right/left deflection is 0 degree is fn degree (see FIG. 9). In the straight line Lt1, the face angle when the right/left deflection is 0 degree is ft degree (see FIG. 9).

Figure 10:
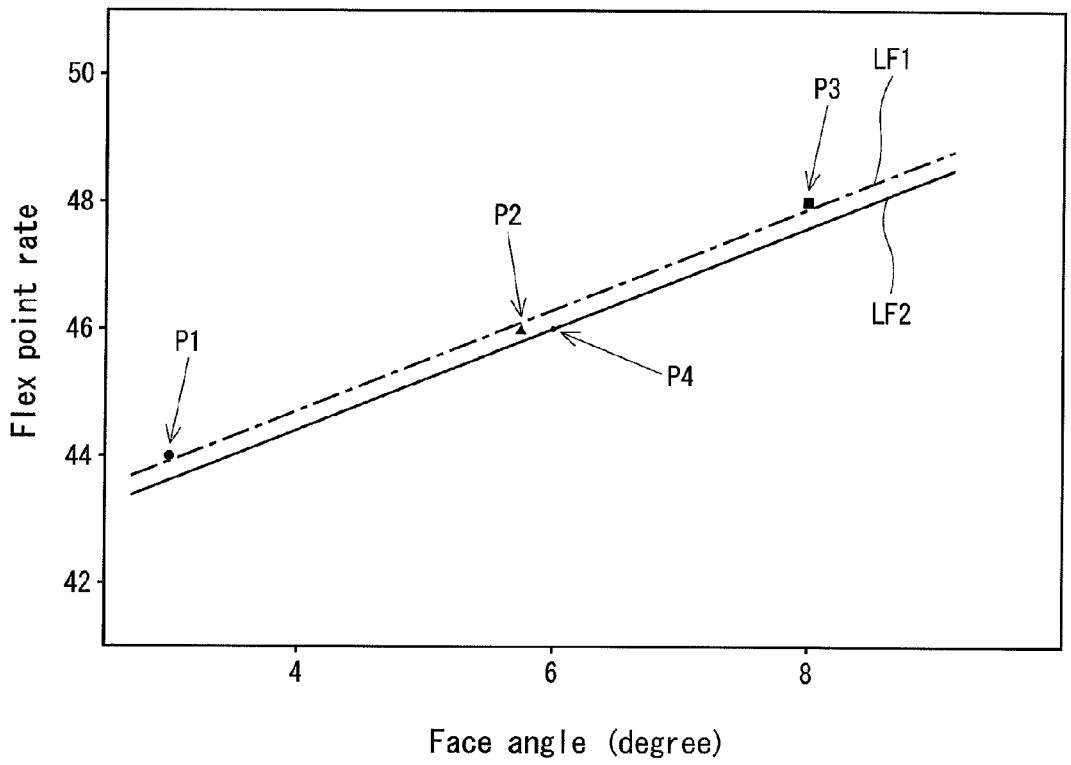
FIG. 10 is a graph showing other relationship (relational expression F1) of the flex point rate and the face angle when the right/left deflection is small.

Now, a method for determining the straight line LF1 as shown in FIG. 6 will be described. The straight line LF1 is also shown in FIG. 10. Point P1 in FIG. 6 shows a combination of a high flex point (flex point rate 44%) and a face angle when an angle of right/left deflection is 0 degree. Specifically, coordinates of the point P1 are (ft, 44). Point P2 shows a combination of a middle flex point (flex point rate 46%) and a face angle when an angle of right/left deflection is 0 degree. Specifically, coordinates of the point P2 are (fn, 46). Point P3 shows a combination of a low flex point (flex point rate 48%) and a face angle when an angle of right/left deflection is 0 degree. Specifically, coordinates of the point P3 are (fs, 48).

As an approximate linear function expression passing through the points P1, P2, and P3, the straight line LF1 is determined. Here, the straight line LF1 is determined by the least-square method from these three points.

The straight line LF1 is shown by the following approximate linear expression when a shaft flex point rate is Y and a value of the face angle is X. The approximate linear expression is one example of a relational expression F1 in the present invention.

$$Y=A1\cdot X+B$$

(coefficient A1 and intercept B are constants.)

With the relational expression F1, a shaft flex point rate Y fitted to the subject can be calculated based on the measured face angle X.

Preferably, the above-mentioned A1 is a positive value. Specifically, the relational expression F1 is preferably such a relational expression that the greater the face angle X is, the lower (the greater) the shaft flex point Y is. In addition, this means that the greater the face angle X is, the more open the face angle is. In the case of a right-handed golf player, a positive face angle X means that the face faces to the right, and negative face angle means that the face faces to the left. As a flex point rate is the greater its value, the lower flex point the shaft is. A method for calculating a shaft flex rate will be described below.

In addition, the relational expression F1 is not limited to a linear expression, and a quadratic or polynomial expression may be listed. An approximate expression is not limited to a linear expression, and a quadratic or polynomial expression may be listed.

A fitting method by combining two hitting results will be exemplified hereinafter. As compared with a case in which one hitting result is used, the fitting accuracy can be better by using two hitting results. Here, as two hitting results, a ball direction and a result of a flight distance are used. In the embodiment, as a ball direction, a right/left deflection is used. In the embodiment, as a result of a flight distance, a flight distance ratio is used. The flight distance ratio is a relative value of the flight distance. An absolute value of the flight distance may be used instead of the flight distance ratio. Typically, an absolute value of the flight distance is expressed in yard or meter.

In the embodiment, a relational expression F1 (straight line LF1) based on a first hitting result is modified based on a second hitting result. The modification will be described using FIG. 10 and FIG. 11. Here, a right/left deflection is adopted as a first hitting result, and a flight distance ratio is adopted as a second hitting result.

First, as described above, based on the right/left deflection (first hitting result), the straight line LF1 (relational expression F1) is determined. Then, based on the fight distance ratio (second hitting result), the straight line LF1 is modified. The modification is based on correlation Rx of the flight distance ratio and the face angle.

Figure 11:
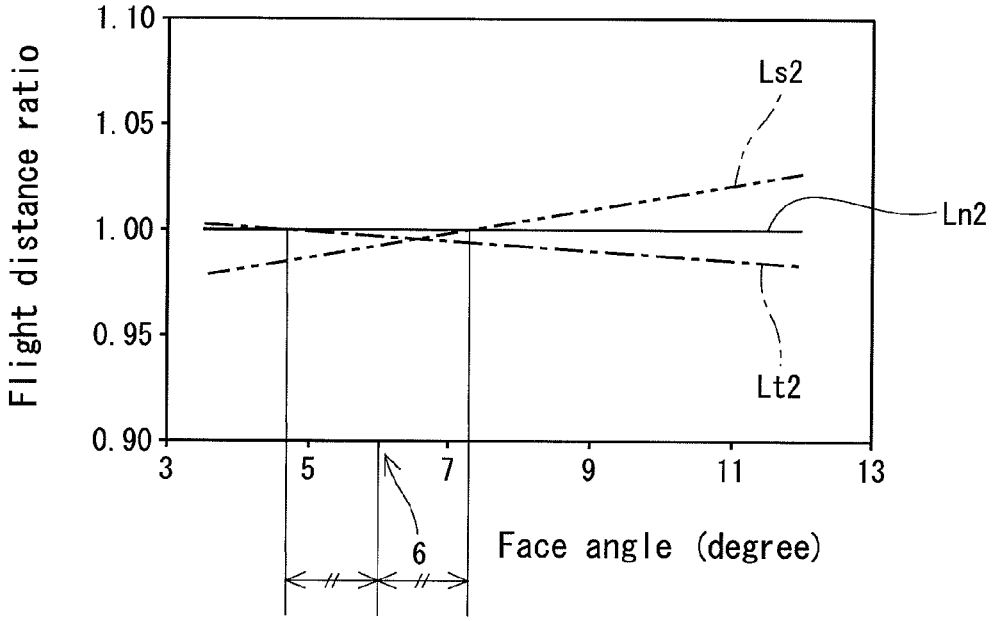
FIG. 11 is a graph showing a relationship (correlation R, correlation Rx) of the face angle and a flight distance ratio for each flex point rate.

FIG. 11 is a graph showing the correlation Rx. In FIG. 11, the correlation Rx of the flight distance ratio and the face angle is determined for each flex point rate. A database used in creation of FIG. 11 is common to that used in creation of FIG. 8. As the correlation Rx, three relational expressions are determined. The relational expressions are determined by the regression analysis with the least-square method.

Here, based on the correlation Rx, a range in which preferred results are obtained in the shaft having a middle flex point (flex point rate 46%) is selected. As shown in FIG. 11, in the embodiment, for the shaft having the middle flex point, a particularly preferable results can be obtained when the face angle is between 4.7 degrees and 7.3 degrees. Specifically, in this range, the shaft having the middle flex point (flex point rate 46%) has a higher flight distance ratio than a shaft having a high flex point (flex point rate 44%) and that having a low flex point (flex point rate 48%). In FIG. 11, when the face angle is between 4.7 degrees and 7.3 degrees, the straight line Ln2 (middle flex point) is in upper side than the straight line Ls2 (low flex point) and the straight line Lt2 (high flex point). For example, any value is selected from the preferable range (between 4.7 degrees and 7.3 degrees). Preferably, a median of the preferable range is selected. The median is 6.0 degrees.

In FIG. 10, the straight line LF2 is determined from the straight line LF1. The straight line LF2 has a same inclination A1 as the straight line LF1. In the straight line LF2, a value of the intercept B is modified so that it passes through the point P4 of the middle flex point (flex point rate 46) and the face angle of 6.0 degrees. Specifically, the straight line LF2 is a straight line which passes through the point P4 (6.0, 46) and has a same inclination as the straight line LF1. The straight line LF2 may be used as a relational expression F1, instead of the straight line LF1. The straight line LF2 is a relational expression F1 obtained by modifying the relational expression F1 (straight line LF1) obtained based on the first hitting result (right/left deflection), on the basis of the second hitting result (flight distance ratio). In the modification, the relational expression F1 (straight line LF1) is modified so that the second hitting result (flight distance ratio) is preferable at the middle flex point (flex point rate 46%). Here, as a standard shaft flex point rate Yh, the flex point rate 46% is adopted. The two hitting results are considered in the straight line LF2. Thus, if the expression for the straight line LF2 is used as the relational expression F1, the fitting accuracy can be improved.

Figure 12:
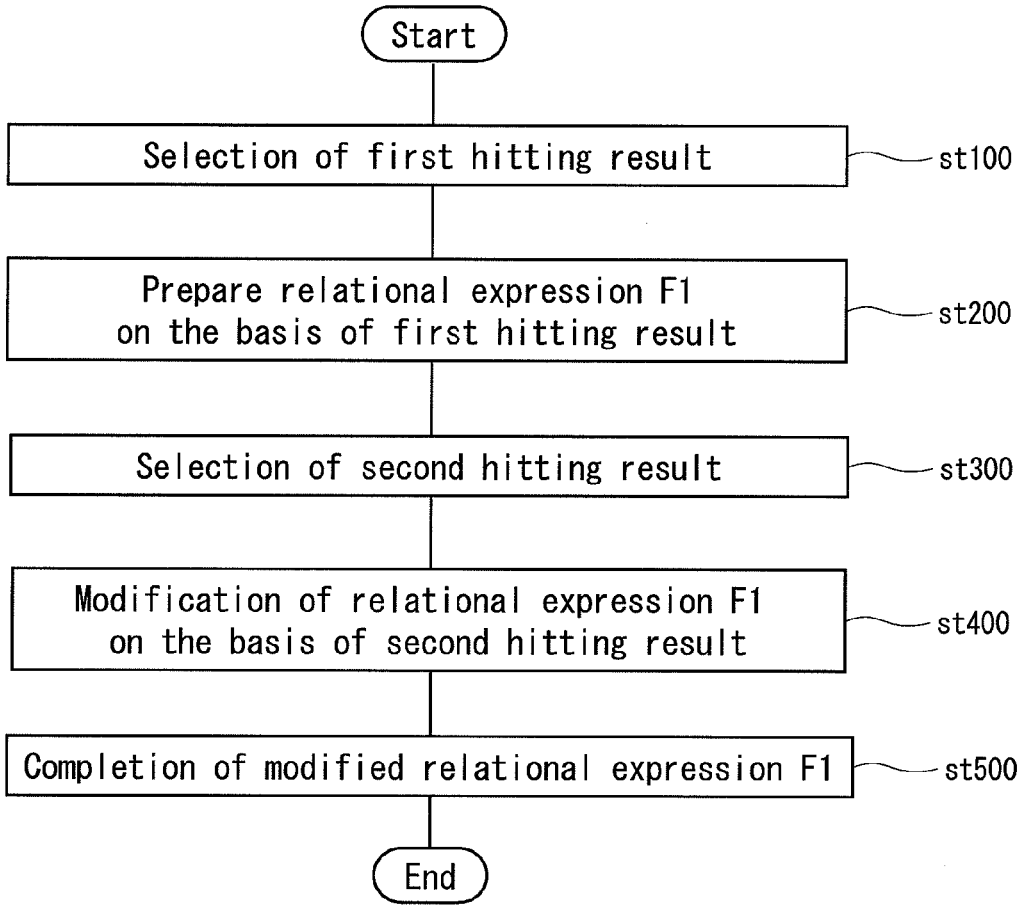
FIG. 12 is a flow chart showing an example of a preferred fitting method.
Figure 13:
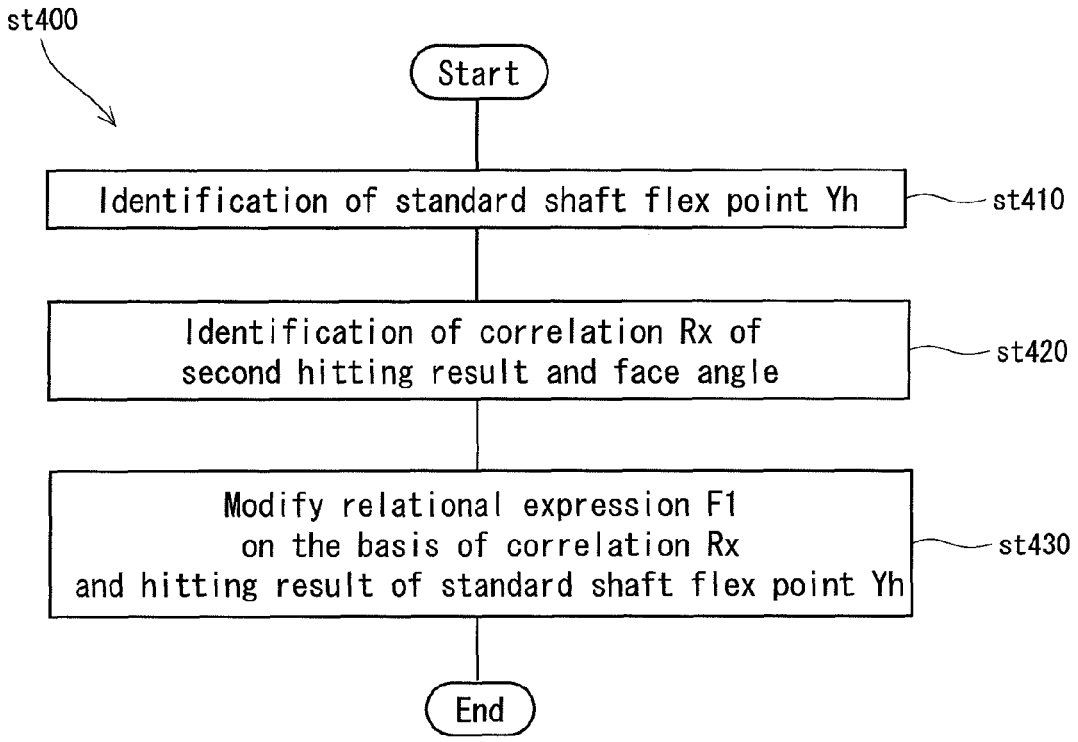
FIG. 13 is a flow chart showing an example of a preferable method for modifying the relational expression F1.

FIG. 12 and FIG. 13 are flow charts for explaining the embodiments described above according to FIG. 8 to FIG. 11. With reference to the flow charts, each step of the above embodiment will be described.

As shown in FIG. 12, in the embodiment, a first hitting result is selected (step sp100). In the embodiment, a ball direction (right/left deflection) is selected as the first hitting result.

Then, based on the first hitting result selected in step sp100, a relational expression F1 is created (step sp200). In the embodiment, the relational expression F1 in the step sp200 is an expression of the straight line LF1.

Then, a second hitting result is selected (step sp300). In the embodiment, a result on a flight distance is selected as the second hitting result. In the embodiment, as the result of the flight distance, a flight distance ration is adopted.

Then, based on the second hitting result (flight distance ratio), the relational expression F1 (expression of the straight line LF1) is modified (step sp400). In the embodiment, the modified relational expression F1 is an expression of the straight line LF2. The straight line LF2 as the modified relational expression LF1 is complete (step sp500).

FIG. 13 is a flow chart showing details of the step sp400 (modification step). In the modification step, a standard shaft flex point Yh is identified (step sp410). In the above embodiment, "flex point rate 46%" is adopted as the standard flex point rate Yh.

Then, correlation Rx of the second hitting result and the face angle is identified (step sp420). In the embodiment, the correlation Rx is shown in the graph of FIG. 11. In addition, the correlation Rx refers to a correlation R which is used in the modification of the relational expression F1.

Then, based on the correlation Rx, the relational expression F1 is modified (step sp430). As stated above, in the modification, the hitting result (second hitting result) at the standard shaft flex point Yh is considered. In the embodiment, the point P4 based on the correlation Rx is determined, and the relational expression of the straight line LF1 is modified based on the point P4. With the modification, the straight line LF2 is obtained.

In the step sp400, the relational expression F1 (expression of the straight line LF1) is modified so that the second hitting result is preferable at the standard shaft flex point Yh (flex point rate 46%). The correlation Rx is used to reflect favorability of the second hitting result in the relational expression F1. In other wards, the modification is made so that the second hitting result (flight distance ratio) will be preferable in the step sp430, at the standard shaft flex point Yh (46%).

As described above, the preferable hitting result at the standard shaft flex point Yh is reflected in the relational expression F1. This reflection increases correlation of the relational expression F1 and the preferable hitting result, and thus the fitting accuracy can be improved.

In the following, the relational expression F1 will be described in more detail.

As stated above, for the relational expression F1, a quadratic or polynomial expression or the like may be used, in addition to a linear expression. Now, a case of a linear expression will be described.

As stated above, the linear relational expression F1 is expressed by the following expression 1:

$$Y=A1\cdot X+B \quad \text{(Expression 1)}$$

If the face angle X is Xd1 when a subject uses a test club (a shaft flex point rate is D1), a flex point rate Y1 to be recommended to the subject is determined based on the above (Expression 1):

$$Y1=A1\cdot Xd1+B$$

Preferably, in the (Expression 1), preferred hitting result at the standard shaft flex point Yh is reflected. The relational expression F1 in which the preferable hitting result is reflected is referred to as a relational expression F1*p* in the following. One example of the relational expression F1*p* is an expression of the straight line LF2. It can be said that the relational expression F1*p* is a relational expression F1 which is made preferable by the standard shaft flex point Yh. Therefore, if the flex point rate D1 of the test club matches the standard shaft flex point Yh, the relational expression F1*p* shows especially good accuracy.

The relational expression F1*p* may be used, irrespective of a shaft flex point rate to be used in fitting. However, the relational expression F1*p* is preferable, in particular, when the flex point rate D1 of the test club matches the standard shaft flex point Yh, as described above. Thus, it is preferable that the relational expression F1*p* is modified based on the flex point rate of the test club to be used in fitting.

The modified relational expression F1 is expressed by the following expression 2:

$$Y=A1\cdot X+B+(D1-Yh) \quad \text{(Expression 2)}$$

With the modified relational expression F1, a recommended flex point rate can be determined with accuracy even if the shaft flex point rate D1 of the test club differs from the standard shaft flex point Yh.

In the relational expression F1 of the Expression 2, the measured face angle X is made a first input variable, and a value indicating a relationship of the shaft flex point D1 of the test club and the standard shaft flex point Yh is made a second input variable. In the relational expression F1 of the Expression 2, the shaft flex point Y of the head fitted to the subject is made a result variable. With such a relational expression F1, the fitting accuracy can be imposed, irrespective of the shaft flex point to be used in fitting.

In the embodiment described above, as the relationship C, the relational expression F1 is used. The relationship C may not be a relational expression. An example of the relationship C which is not a relational expression will be described below.

The relationship C is a relationship of the face angle X and the shaft flex point Y. In addition to the face angle X, other elements may be considered. For example, the relationship C may be a relationship of the face angle X, an attack angle, and the shaft flex point Y. The relational expression F1 may be a relational expression of the face angle X, an attack angle, and the shaft flex point Y. The incident angle shows a direction of head trajectory before impact. As an example of the attack angle, an angle of the head trajectory when viewed from the above is listed.

EXAMPLE

In the following, effect of the invention will be revealed by an example. However, the present invention should not be interpreted in a limited way based on a description of the example.

[Flex Point Rate]

In general, a shaft whose tip side tends to bend is referred to as a low flex point. In addition, generally, a shaft whose butt end side tends to bend is referred to as a high flex point. The terms low flex point, middle flex point, and high flex point are known in the market as indicators showing a shaft physical property. However, the standards for the low flex point, middle flex point, and high flex point are not necessarily uniform in those skilled in the art. Under present circumstances, a plurality of standards of a flex point exists.

In the example, a flex point rate C1 to be determined with the following expression is determined. In the example, when the flex point rate C1 is 45% or less, it is determined as a high flex point. When the flex point rate C1 is greater than 45% and less than 47%, it is determined as a middle flex point. When the flex point rate C1 is equal to or greater than 47%, it is determined as a low flex point.

$$C1=[F2/(F1+F2)]\times 100$$

However, F1 is a forward flex (mm). F2 is a backward flex (mm).

[Measurement of Forward Flex F1]

Figure 14A:
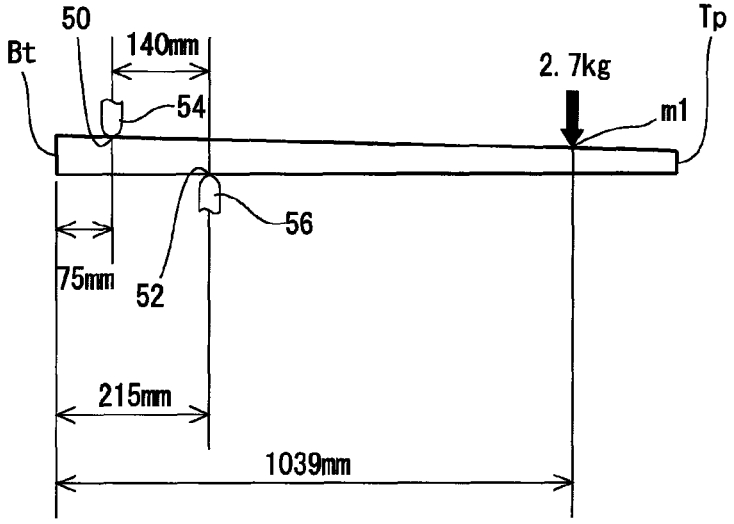
FIG. 14A is an illustration of a method for measuring a forward flex.

FIG. 14A is an illustration for describing a method for measuring a forward flex F1. As shown in FIG. 14A, a first supporting point 50 was set at a position which is 75 mm from the shaft butt end Bt. Furthermore, a second supporting point 52 was set at a position which is 215 mm from the shaft butt end Bt. A supporting body 54 which supports the shaft from above is provided at the first supporting point 50. A supporting body 56 which supports the shaft from below was provided at the second supporting point 52. With no load, a shaft axial line of the shaft 20 was made almost horizontal. Load of 2.7 kg was caused to act vertically downward on a loaded point m1 which was 1039 mm from the shaft butt end Bt. A travel distance (mm) of the loaded point m1 from no load state to loaded state was made a forward flex F1. The travel distance was a travel distance along a vertical direction.

In addition, cross sectional shapes of parts of the supporting body 54 which abut the shaft (hereinafter referred to as abutting parts) are as follows. In a cross section parallel to a shaft axial direction, a cross sectional shape of the abutting part of the supporting body 54 has convex roundness. A curvature radius of the roundness is 15 mm. In a cross section perpendicular to the shaft axial direction, a cross sectional shape of the abutting part of the supporting member 54 has concave roundness. A curvature radius of the concave roundness is 40 mm. In the cross section vertical to the shaft axial direction, horizontal length (length in a depth direction in FIGS. 14A and 14B) of the abutting part of the supporting body 54 is 15 mm. A cross sectional shape of the abutting part of the supporting body 56 is identical to that of the supporting body 54. A cross sectional shape of an abutting part of a loading indenter (not shown) which gives a load of 2.7 kg at the loaded point m1 has convex roundness on a cross section in parallel to the shaft axial direction. A curvature radius of the roundness is 10 mm. A cross sectional shape of an abutting part of a loading indenter (not shown) which gives a load of 2.7 kg at the loaded point m1 is a straight line on a cross section perpendicular to the shaft axial line. Length of the straight line is 18 mm. In this manner, the forward flex F1 is measured.

[Measurement of Backward Flex F2]

Figure 14B:
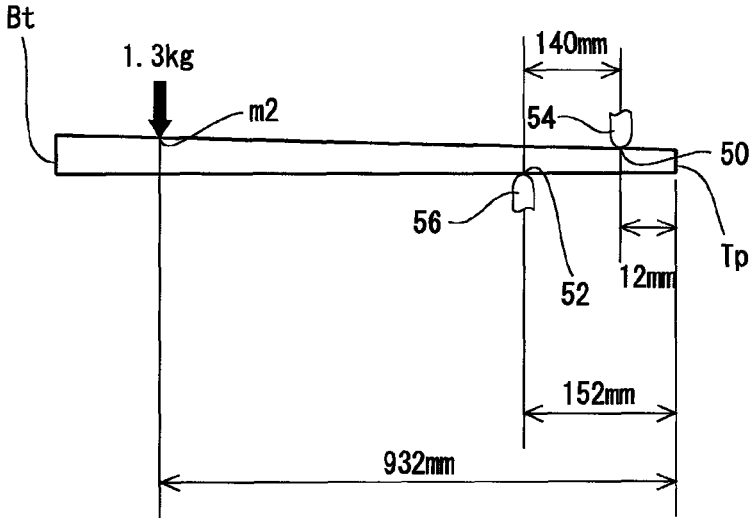
FIG. 14B is an illustration of a method for measuring a backward flex.

FIG. 14B shows a method for measuring a backward flex. A first supporting point 50 was made a point which is 12 mm spaced from a shaft tip Tp, and a second supporting point 52 was made a point which is 152 mm spaced from the shaft tip Tp, and a loaded point m2 was a point which is 932 mm spaced from the shaft tip Tp, and a load is 1.3 kg. Except these items, the backward flex F2 was measured similar to the forward flex F1.

Example 1

Images of swings of 32 golf players were shot. The 32 golf players are advanced golf players whose average score ranges from 72 to 95. The golf players hits 8 balls each with a golf club having a shaft of low flex point, a golf club having a shaft of middle flex point, and a golf club having a shaft of high flex point. An average value of data on the 8 hit balls is used.

Figure 15:
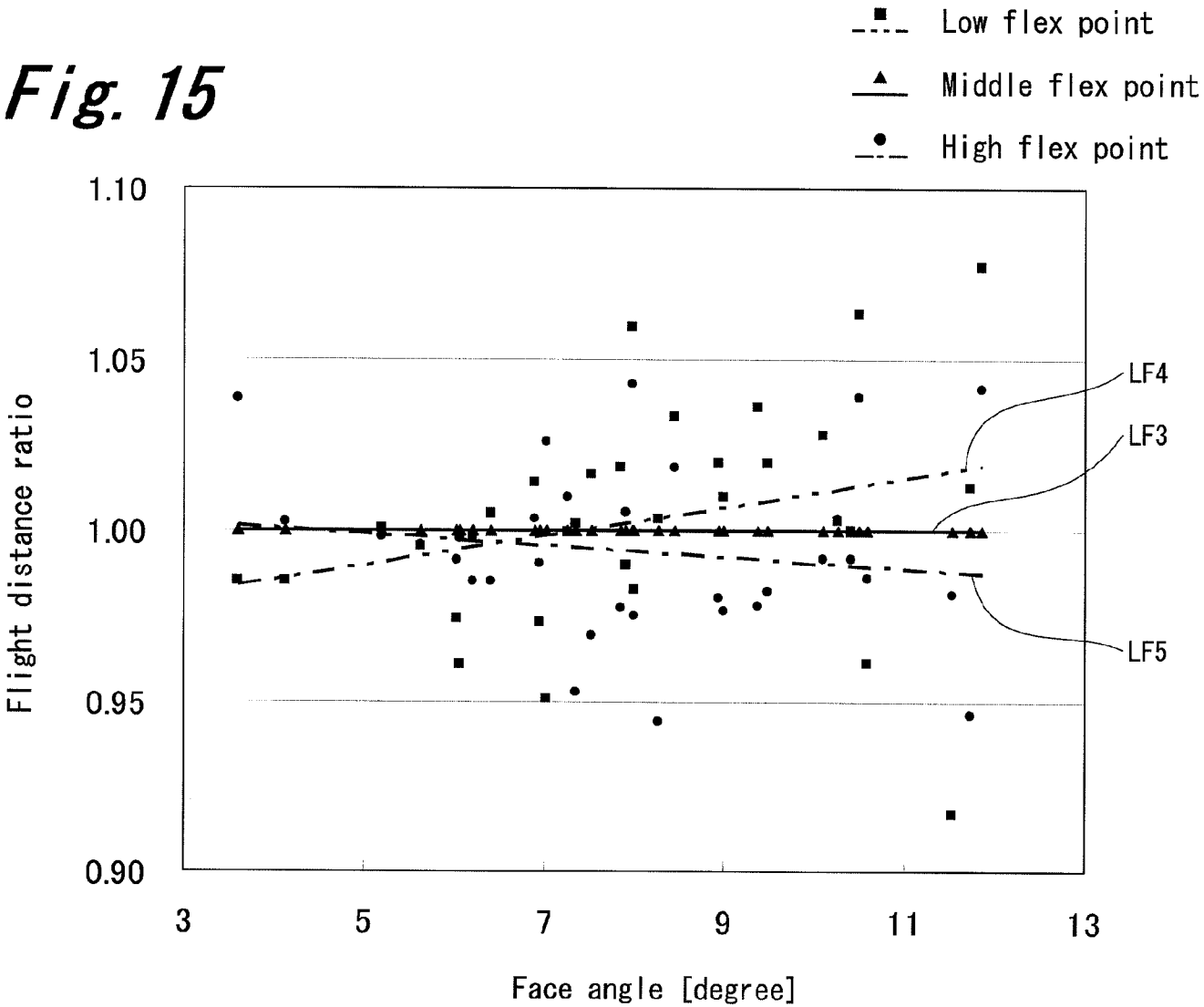
FIG. 15 is a graph showing a relationship of the face angle and the flight distance for each flex point rate.

In FIG. 15, a relationship of the flight distance ratio of the ball as the hitting result and the face angle before impact is shown for each flex point rate. Here, the face angle average of the golf club 36 (middle flex point) is made the horizontal axis. The face angle is an angle of the head before impact when viewed from above. The horizontal axis represents an average value of the face angle before impact of every golf player. The average value is obtained from measurement data on swings of the test clubs by each golf player. Here, a value of the shaft physical property of the test club is a middle flex point.

The solid line LF3 of FIG. 15 shows a linear function of the golf club of middle flex point. The dashed-two dotted line LF4 of FIG. 15 shows a linear function of the golf club of low flex point. The dashed-dotted line LF5 of FIG. 15 shows a linear function of the golf club of high flex point. The linear functions of the golf club of low flex point and of the golf club of high flex point are obtained by the regression analysis with the least-square method.

In FIG. 15, it is judged whether the flight distance ratio Y differs if the average face angle X differs, in the function determined with the low flex point and the high flex point. For example, with this linear function, it is judged whether the relational expression is a function having an inclination. In case that the function determined with the low flex point and the high flex point has an inclination, when the flight distance is made an objective variable with the face angle as an explanatory variable, it can be judged that the face angle has a statistically significant relation with the flight distance.

In case that an inclination of the function determined with the low flex point differs from that of the function determined with the high flex point, when the flight distance is made an objective variable and the face angle and a shaft flex point rate are made an explanatory variable, it is judged that the face angle and the value of the flex point rate have a statistically significant relation with the flight distance. It is judged that the face angle and the flex point rate have a relation of interaction. In this manner, it is judged whether there is a statistically significant relation. For example, it is made a judging standard that whether a product of the face angle and the shaft flex point is significant on the level of 20% (significant level of 20%). More preferably, it is made a judging standard that whether the product is significant on the level of 10% (significant level of 10%).

In FIG. 15, an inclination of the linear function determined with the golf club of low flex point is 0.004163. An inclination of the linear function determined with the golf club of high flex point is −0.001642. The inclinations are with respect to the test club (middle flex point). When the flight distance is made an objective variable and the face angle as an explanatory variable, the face angle has a statistically significant relation with the flight distance. It is judged that the flight distance which is made an objective variable has a statistically significant relation with the face angle and the shaft flex point rate which are made as an explanatory variable. It is judged that the face angle and the shaft flex point rate have an interaction. Therefore, the face angle contributes to the flight distance as a hitting result. The result shows effectiveness of the present invention. The LF3, LF4, and LF5 are one example of the relational expression F1.

Example 2

The measurement data acquired in Example 1 was used. Similar to the fitting method shown in FIG. 8 to FIG. 13, a relational expression F1 which corresponds to the above (Expression 1) was obtained. The relational expression F1 was as per the following (Expression 3):

$$Y=0.8648\cdot X+40.867 \quad \text{(Expression 3)}$$

As described above, in the Example 2, a standard shaft flex point Yh is 46%. When a flex point rate of a test club is 46%, the Expression 3 is particularly preferably used. Specifically, when the flex point rate of the test club is 46%, by assigning the measured face angle X into the Expression 3, a flex point rate Y which is preferred for the subject can be obtained precisely.

Similar to the Expression 2, the Expression 3 was generalized. The generalized expression F4 is as follows: Wherein D1 is a flex point rate of a shaft mounted on a test club.

$$Y=0.8648\cdot X+40.867+(D1-46) \quad \text{(Expression 4)}$$

As shown in Expression 4, irrespective of the flex point rate D1 of the test club, a flex point rate Y fitted to the subject may be calculated.

Based on results of the Expression 3 and Expression 4, the following are listed as a preferable aspect.

When a flex point rate of a test club is $\alpha$% and the measured face angle X is 3 degrees or less, it is preferable that a recommended flex point rate is $(\alpha-2)$% or less. A relationship of the face angle X and the flex point rate is one example of the relationship C.

When a flex point rate of a test club is $\alpha$% and the measured face angle X is 5 degrees or more and 7 degrees or less, it is preferable that a recommended flex point rate is equal to or more than ($\alpha$−1) % and equal to or less than $\alpha$%. A relationship of the face angle X and the flex point rate is one example of the relationship C.

When a flex point rate of a test club is $\alpha$% and the measured face angle X is 9 degrees or more, it is preferable that a recommended flex point rate is ($\alpha$+1) % or more. A relationship of the face angle X and the flex point rate is one example of the relationship C. In this manner, in the present invention, the relationship C is not limited to any relational expression such as the relational expression F1.

The above description is just one example, and various changes can be made without departing from the essence of the present invention.

What is claimed is:

1. A fitting method of a golf club comprising steps of:

performing the following steps by a processor;

preparing a relationship C of a shaft flex point Y and a face angle X before impact or at impact;

calculating a subject's face angle X before impact or at impact by using a test club from measurement data provided by a measuring device; and selecting a shaft fitted to the subject on the basis of the measured face angle X and the relationship C, wherein the relationship C is created by using correlation R of the face angle before impact or at impact and a hitting result, and the correlation R is based on hitting results of a plurality of golf clubs having different shaft flex point rates.

2. The fitting method according to claim 1 wherein the relationship C is a relational expression F1.

3. The fitting method according to claim 2 wherein the relational expression F1 is such a relational expression that the greater the face angle X is, the lower the shaft flex point Y is.

4. The fitting method according to claim 2 wherein the step of preparing the relational expression F1 includes steps of:

obtaining the relational expression F1 on the basis of a first hitting result; and modifying the relational expression F1 on the basis of a second hitting result.

5. The fitting method according to claim 4 wherein the step of modifying the relational expression F1 on the basis of the second hitting result includes steps of:

identifying a standard shaft flex point Yh; and modifying the relational expression F1 so that the second hitting result is preferred at the standard shaft flex point Yh.

6. The fitting method according to claim 4, wherein the first hitting result is a direction of a hit ball; and the second hitting result is a result on a flight distance.

7. The fitting method according to claim 1 wherein a preferred hitting result at a standard shaft flex point Yh is reflected in the relationship C.

8. The fitting method according to claim 2 wherein in the relational expression F1, the measured face angle X is made a first input variable;

a value showing a relationship of a shaft flex point D1 of the test club and the standard shaft flex point Yh is made a second input variable, and the shaft flex point Y fitted to the subject is made a result variable.

9. The fitting method according to claim 1 wherein the hitting result is a direction of a hit ball.

* * * * *